US005743182A

United States Patent [19]

Kobayashi et al.

[11] Patent Number: 5,743,182

[45] Date of Patent: Apr. 28, 1998

[54] STENCIL PRINTING METHOD AND APPARATUS

[75] Inventors: Akio Kobayashi; Yoshifumi Noguchi; Masakazu Kawano; Akira Ikezawa, all of Inashiki-gun, Japan

[73] Assignee: Riso Kagaku Corporation, Tokyo, Japan

[21] Appl. No.: 643,975

[22] Filed: May 7, 1996

[30] Foreign Application Priority Data

May 11, 1995 [JP] Japan ..... 7-138528

[51] Int. Cl.[6] ..... B41M 1/12

[52] U.S. Cl. ..... 101/129; 101/126; 101/127.1

[58] Field of Search ..... 101/114–129

[56] References Cited

U.S. PATENT DOCUMENTS

| | | | |
|---|---|---|---|
| 2,204,935 | 6/1940 | Kampczyk . | |
| 3,221,648 | 12/1965 | Weiss . | |
| 3,372,638 | 3/1968 | Tripp . | |
| 3,463,587 | 8/1969 | Oltra et al. . | |
| 4,098,184 | 7/1978 | Okada et al. | 101/41 |
| 4,519,760 | 5/1985 | Norell | 101/129 |
| 5,050,498 | 9/1991 | Smith . | |
| 5,596,925 | 1/1997 | Hasegawa | 101/127.1 |

FOREIGN PATENT DOCUMENTS

A-62-70523 9/1994 Japan .

*Primary Examiner*—Ren Yan

*Attorney, Agent, or Firm*—Cushman Darby & Cushman IP Group of Pillsbury Madison & Sutro LLP

[57] ABSTRACT

A stencil printing apparatus is provided, which comprises a pressure chamber having a first wall and a second wall both of which face each other and are built up together via a frame-like packing, said first wall comprising a frame member which has flexibility in all directions and on which a diaphragm having flexibility is extended; means for supporting a stencil so as to have the stencil disposed opposite to said diaphragm in the pressure chamber; means for supporting printing paper so as to have the printing paper disposed between the stencil and the second wall in the pressure chamber, and means for reducing pressure in the pressure chamber. The diaphragm may be extended on the frame member by laminating it onto the frame member, and the packing and the means for supporting a stencil may be installed on part of said diaphragm overlapping with the frame member. The means for supporting a stencil may be a pair of fabric fastener, one half of the pair being fixed to the frame member.

13 Claims, 5 Drawing Sheets

STENCIL PRINTING METHOD AND APPARATUS

FIELD OF THE INVENTION

The present invention relates to a stencil printing method and apparatus, and more specifically relates to a stencil printing method and apparatus of a duplicator-type utilizing pressing force effected under reduced pressure.

BACKGROUND INFORMATION

As a stencil printing apparatus of a duplicator-type suitable to effect even large-size stencil printing at a desired uniform concentration, a stencil printing apparatus utilizing thrust effected under reduced pressure is proposed in Japanese Patent Laid-open (Kokai) No. 270523/94. The printing apparatus comprises a pressure chamber which is composed of a box having a wall in which a diaphragm having at least either flexibility or elasticity is extended, means for reducing pressure in the pressure chamber, and means for supporting a stencil so as to fix the stencil opposite to the diaphragm in the pressure chamber.

In this type of stencil printing apparatus utilizing reduced pressure, printing is effected by placing on a side of a stencil a lump of printing ink which has a consistency sufficient to self-hold the shape of the lump, installing the stencil in the box so that the side on which the printing ink has been placed faces the diaphragm, and reducing pressure in the box so as to allow the diaphragm to exert thrust on the lump of ink to transfer it onto a surface to be printed while the diaphragm comes into close contact with the lump of ink on the stencil and the stencil also comes into close contact with the surface to be printed.

In the stencil printing apparatus disclosed in the Japanese Patent Laid-open (Kokai) No. 270523/94, the box used as a pressure chamber comprises a body the upper surface of which is open and a cover which is a free-like member hinged to the body to readily open and close the box. The free-like member has a diaphragm extended on the central opening thereof. The diaphragm is made of a flexible material. However, the Japanese Patent Laid-open (Kokai) No. 270523/94 does not refer to any material for the other parts of the box, though it suggests that rubber magnet plates be attached to joining portions of the body and the cover to make the box airtight.

The present inventors have found that when the cover is made of a rigid material in order to improve the joining of the body and the cover and make the pressure chamber highly sealed, the cover prevents the diaphragm from bending under reduced pressure in the pressure chamber so that a sufficient pressing force cannot be exerted on the stencil and the printing ink placed thereon. Furthermore, when lumps of ink are unevenly placed on the stencil, pressing force is not exerted uniformly, and if pressure is excessively reduced, the diaphragm is excessively deformed to cause it to be degraded earlier.

Further, if the cover is made of a heavy material in order to enhance airtightness of the pressure chamber, the printing apparatus becomes hard to handle. Also, if rubber magnet plates are used as a junction for the body and the cover as stated above, the number of parts are increased to make the apparatus complicated.

SUMMARY AND OBJECTS OF THE INVENTION

An object of the present invention is to provide stencil printing method and apparatus of the above-mentioned type utilizing reduced pressure, in which the diaphragm is not only relieved of excessive load of bending so as to be prevented from degrading but also able to uniformly exert pressing force on lumps of ink placed on a stencil.

Another object of the present invention is to provide a stencil printing apparatus utilizing reduced pressure, which is simple in structure and easy to assemble.

According to one aspect of the present invention, a stencil printing method is provided, which comprises placing a lump of printing ink on a side of a stencil, said printing ink having a consistency sufficient to self-hold a shape of said lump; disposing said stencil in a pressure chamber the wall of which is partly constituted by a diaphragm having flexibility, while the side of the stencil on which the printing ink has been placed, faces said diaphragm; and reducing pressure in the pressure chamber to bring the diaphragm into close contact with the lump of printing ink and simultaneously bring the stencil into close contact with a surface to be printed, so that stencil printing is effected on the surface by virtue of pressing force exerted by the diaphragm on the lump of ink, characterized in that said pressure chamber comprises a first wall constituted by a frame member on which said diaphragm is extended, and in that the frame member is made of a material having flexibility in all directions, so that the frame member bends coinciding with the diaphragm being bent under reduced pressure to uniformly exert pressing force on the stencil and the lump of ink as well as to relieve the diaphragm of excessive load of deformation.

The pressure chamber of the present invention can be formed, for example, by building up the first wall having the diaphragm, by way of a frame-like packing, on a second wall placed opposite to the first wall. The second wall maybe shaped like a pan having a rim opposed to the perimeter of the frame member, such as the body of the box disclosed in Japanese Patent Laid-open (Kokai) No. 270523/94 mentioned above or the corresponding co-pending U.S. patent application Ser. No. 08/514,983 filed Aug. 14, 1995 that is a continuation application of U.S. Ser. No. 08/212,833 filed Mar. 15, 1994, the disclosure of which is incorporated herein by reference. Or, if printing is effected directly on a large article such as a wall of buildings and the like, the second wall may be the article itself. The diaphragm of the present invention has flexibility as mentioned above. The term "flexibility" should herein be construed in a broad sense that includes not only plastic deformation but also elasticity.

According to another aspect of the present invention, a stencil printing apparatus is provided, which comprises a pressure chamber having a first wall and a second wall both of which face each other and are built up together via a frame-like packing, said first wall comprising a frame member which has flexibility in all directions and on which a diaphragm having flexibility is extended; means for supporting a stencil so as to have the stencil disposed opposite to said diaphragm in the pressure chamber; means for supporting printing paper so as to have the printing paper disposed between the stencil and the second wall in the pressure chamber; and means for reducing pressure in the pressure chamber.

The frame member of the present invention should have a strength sufficient to support the diaphragm, but must be less flexible than the diaphragm. For example, the frame member can be made of elastic metals or plastics.

The diaphragm of the present invention may be made of any material as long as it has flexibility and/or elasticity to an extent that it can exert pressing force on a stencil on which ink has been placed to effect printing on printing paper. For example, the diaphragm can be made of a pliable film having flexibility or elasticity, such as of soft vinyl chloride and rubber.

The diaphragm may be formed with the frame member to be integrated together into one body. However, a diaphragm having substantially the same dimension as the perimeter of the frame member may be laminated on the frame member to extend the former on the latter. In this case, it is preferred that a packing and a means for supporting a stencil are fixed to the diaphragm at a portion where the diaphragm overlaps with the frame member, namely, a portion other than that over the opening of the frame member. If a unit or module, in which a packing and a means for supporting a stencil are previously fixed onto a diaphragm, is formed, a diaphragm which has been degraded can readily be changed with new one by just replacing the unit as a whole.

The packing of the present invention may be made of any material as long as it can form a sealed pressure chamber. It is preferable to use a packing made of a material which is impermeable to air and has flexibility or resiliency to an extent that pressure reduction upon printing is not hindered, such as EPDM.

According to still another aspect of the present invention, a stencil printing apparatus is provided, which comprises a wall comprising a frame member which is made of a material flexible in all direction and on which a diaphragm having flexibility is extended; a frame-like packing disposed on said frame member so as to seal a space between said wall and a surface on which said wall is placed via said packing; means for supporting a stencil so as to have the stencil disposed opposite to said diaphragm in said space, and means for reducing pressure in said space. This printing apparatus is useful to effect printing directly on a large article such as a wall of buildings as mentioned above. In other words, if the printing apparatus is placed by way of the packing on a surface to be printed such as a wall of buildings, a pressure chamber can be formed by the wall and the packing of the printing apparatus and the surface to be printed, thereby enabling the printing apparatus to effect printing on the surface under reduced pressure.

In the present stencil printing method and apparatus, the frame member which supports the diaphragm is made of a material flexible in all directions, and thus is bent at the same time when the diaphragm is bent under reduced pressure. Thus, the diaphragm can closely contact a stencil and lumps of ink placed on the stencil, and can uniformly exert thrust thereon even if lumps of ink are unevenly placed. Also, the diaphragm is not excessively deformed, and thus prevented from degrading. In addition, owing to the flexibility of the frame member itself, even when a surface to be printed is curved, the diaphragm readily fits the curved surface.

BRIEF DESCRIPTION OF THE FIGURES

Hereinafter, the present invention will be explained in more detail with reference to presently-preferred embodiments shown in the accompanying drawings in which.

DETAILED DESCRIPTION OF THE INVENTION

Figure 1:
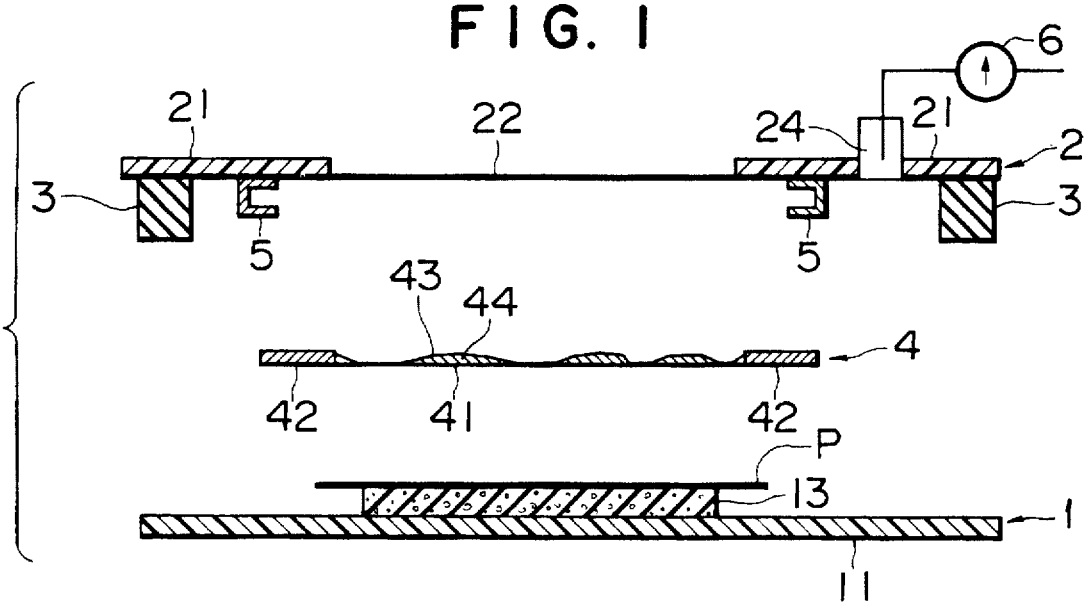
FIG. 1 is a sectional view showing an embodiment of the present stencil printing apparatus in an exploded state.
Figure 2:
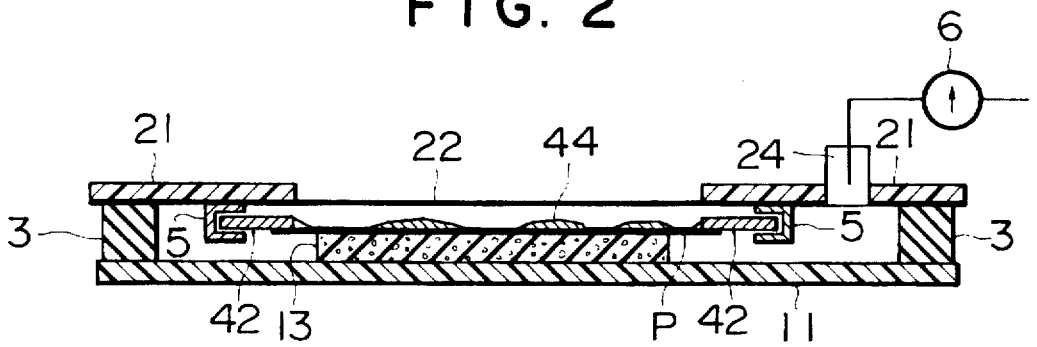
FIG. 2 is a sectional view showing the stencil printing apparatus of FIG. 1 in an assembled state under atmospheric pressure.
Figure 3:
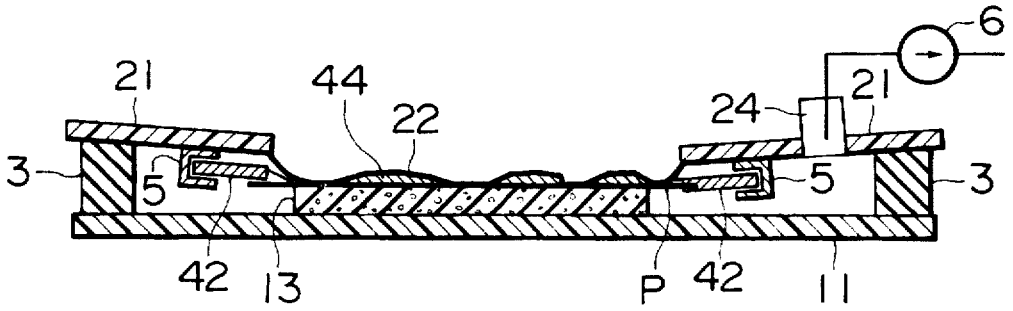
FIG. 3 is a sectional view showing the stencil printing apparatus of FIG. 2 under reduced pressure.

FIGS. 1 to 3 are sectional views which show an embodiment of the present stencil printing apparatus. The printing apparatus generally comprises a platform 1, an upper plate 2, a packing 3, means for supporting a stencil 5 and means for reducing pressure 6. The upper plate 2 corresponds to the first wall referred to above, and the platform 1 corresponds to the second wall referred to above.

The platform 1 consists of a lower plate 11 of rectangular shape and a printing paper mount 13 which is placed on the central region of the lower plate 11 as a means for supporting printing paper. The upper plate 2 comprises a rectangular frame member 21 which has a rectangular opening in a central portion thereof, and a diaphragm 22 which has the same shape as the perimeter of the frame member 21 and is laminated on and bonded to the lower surface of the frame member 21. The packing 3 shaped like a frame is fixed to the lower surface of the diaphragm 22 along the periphery thereof. Means for supporting a stencil 5, which are a pair of rails facing each other with the opening of the frame member 21 between, are also fixed on the lower surface of the diaphragm 22 inside the packing 3. Inside the packing 3, the upper plate 2 also has a suction port 24 which is a hole penetrating the frame member 21 and the diaphragm 22. The suction port 24 is connected to means 6 for reducing pressure. The frame member 21 can be made of a metal sheet such as of SPCC (iron plate) or a plastic sheet such as of vinyl chloride and ABS. The diaphragm 22 can be made of a plastic sheet such as of vinyl chloride and rubber.

As shown in FIG. 2, only if the upper plate 2 is placed by way of the packing 3 on the lower plate 11 of the platform 1, a pressure chamber, the walls of which are defined by the upper plate 2, the lower plate 11 and the packing 3, is formed in this stencil printing apparatus.

Upon printing, before the upper plate 2 is placed on the platform 1, printing ink having a consistency sufficient to self-hold its shape is placed as lumps 44 of ink on a stencil 41 of a stencil unit 4, and is covered by ink covering sheet 43. Thereafter, the stencil unit 4 is installed on the upper plate 2 by inserting each of the right and the left edges of the frame 42 of the stencil unit 4 into each of the pair of rails 5 of the stencil supporting means while the side of the stencil unit 4 on which printing ink has been placed is directed to the diaphragm 22.

The stencil unit 4 consists of a stencil 41, a frame 42 which is made of cardboard, plastic or the like and on which the stencil 41 is extended, and an ink covering sheet 43 which is fixed to the frame 42 so as to readily be turned up and down. However, the ink covering sheet 43 may be omitted if it is unnecessary. The stencil unit 4 may have substantially the same structure as the stencil unit disclosed in U.S. Pat. No. 4,128,057 the disclosure of which is incorporated herein by reference and to which reference is to be made for details of the structure. The stencil 41 may be a heat-sensitive stencil paper or sheet which is a laminate of an ink-impermeable thermoplastic film and a porous support of an ink-permeable sheet such as of Japanese paper or woven fabric.

Printing ink used herein is preferably an emulsion ink having a consistency sufficient to self-hold its shape, such as those having 32 or less of a flow value in one minute measured by a spreadometer, as disclosed in Japanese Patent Publication (Kokoku) No. 23601/79. The printing ink may further be thixotropic.

Then, after printing paper P is placed on the mount 13, the upper plate 2 on which the stencil unit 4 has been installed is built up via the packing 3 on the lower plate 11 to form a pressure chamber, as shown in FIG. 2. When pressure is reduced in the pressure chamber by use of the pressure reducing means 6 connected to the suction port 24, the diaphragm 22 comes into close contact with the lumps 44 of ink and also brings the stencil 41 into close contact with the printing paper P, as shown in FIG. 3. Since the diaphragm further exerts thrust on the lumps 44 of ink place on the stencil 41, printing is effected on the printing paper P.

Since the frame member 21 supporting the diaphragm 22 is also made of a material having flexibility in all directions, the edges of the opening of the frame member 21 are also bent downwardly under reduced pressure as shown in FIG. 3. Thus, the frame member 21 does not prevent the diaphragm 22 from contacting the stencil unit, but allows the diaphragm 22 to exert pressing force uniformly even if lumps of ink are placed unevenly. Since the diaphragm 22 is less deformed but is not forced to be excessively bent, it is prevented from degrading. In addition, when reduction of pressure is released after printing, the frame member 21 restores the flat form that has been taken before pressure reduction. In this instance, the frame member 21 raises the lateral portions of the diaphragm 22 from the stencil 41, and thus the diaphragm 22 is peeled off at a greater angle with printing paper. Furthermore, since the upper plate 2 can be bent, it is readily opened and closed and facilitates operation of peeling off the printing paper.

In the stencil printing apparatus of FIGS. 1 to 3, means for supporting a stencil is a pair of rails 5 which are elongated members. Thus, the rails 5 tend to function as reinforcing ribs in the direction of extension on the upper plate 2, thereby preventing the frame member 21 from bending in a direction transverse to the rails 5. Hereinafter, another embodiment which eliminates such a tendency will be explained with reference to FIGS. 4 to 8.

Figure 5:
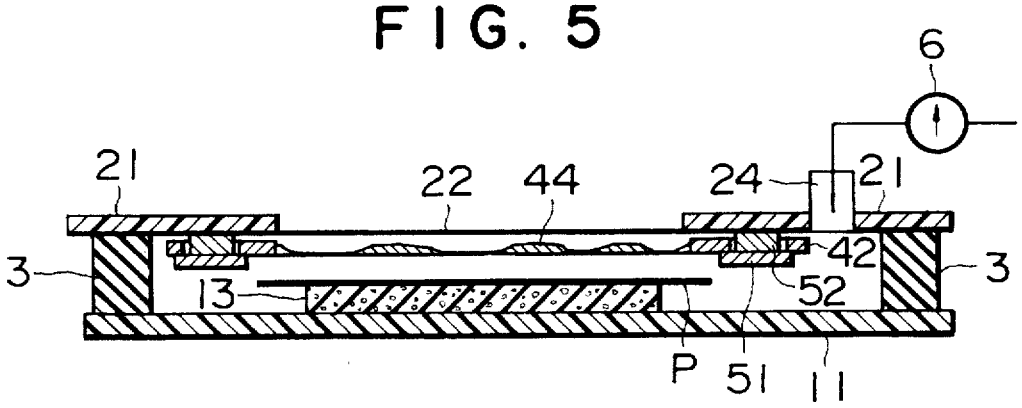
FIG. 5 is a sectional view showing the stencil printing apparatus of FIG. 4 in an assembled state under atmospheric pressure.
Figure 6:
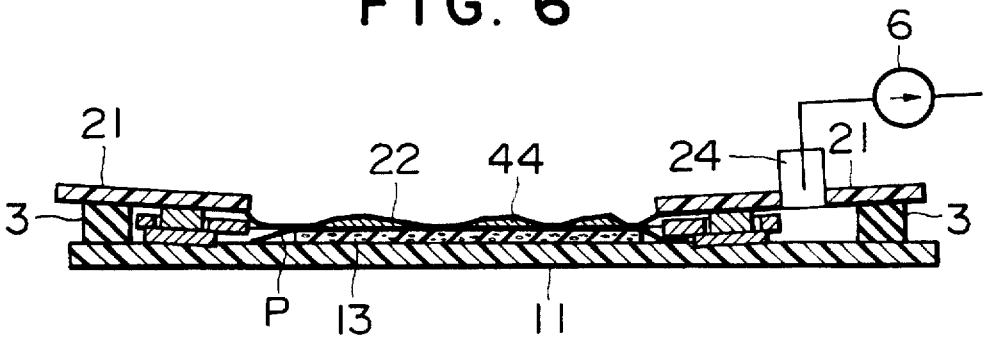
FIG. 6 is a sectional view showing the stencil printing apparatus of FIG. 5 under reduced pressure.
Figure 7A:
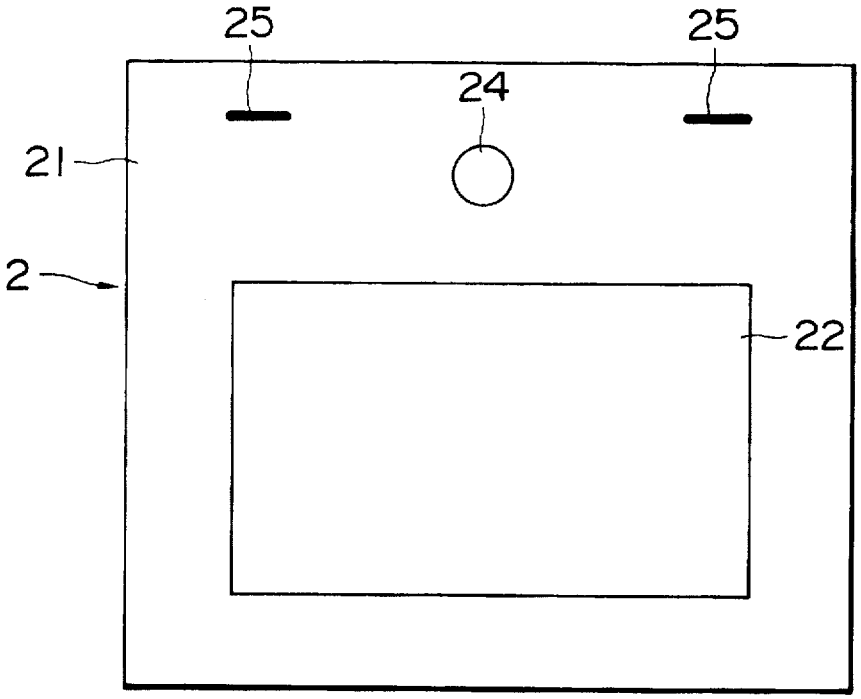
FIG. 7*a* is a plan view showing the upper plate of FIGS. 4–6 with a stencil unit being attached thereto.
Figure 7B:
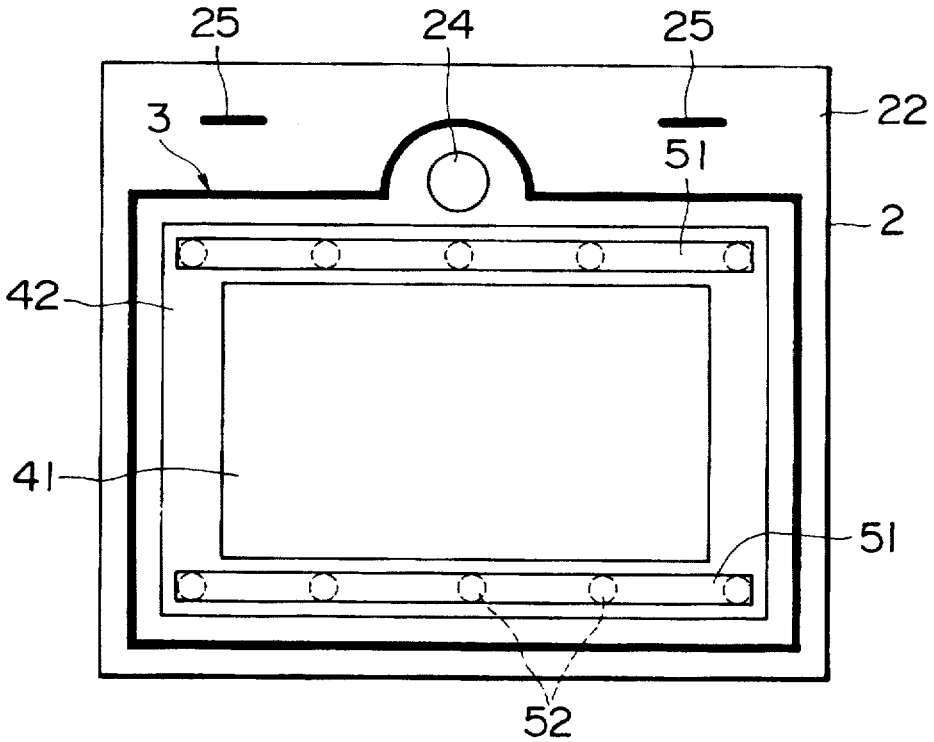
FIG. 7*b* is a bottom view of the upper plate of FIG. 7*a*.
Figure 8:
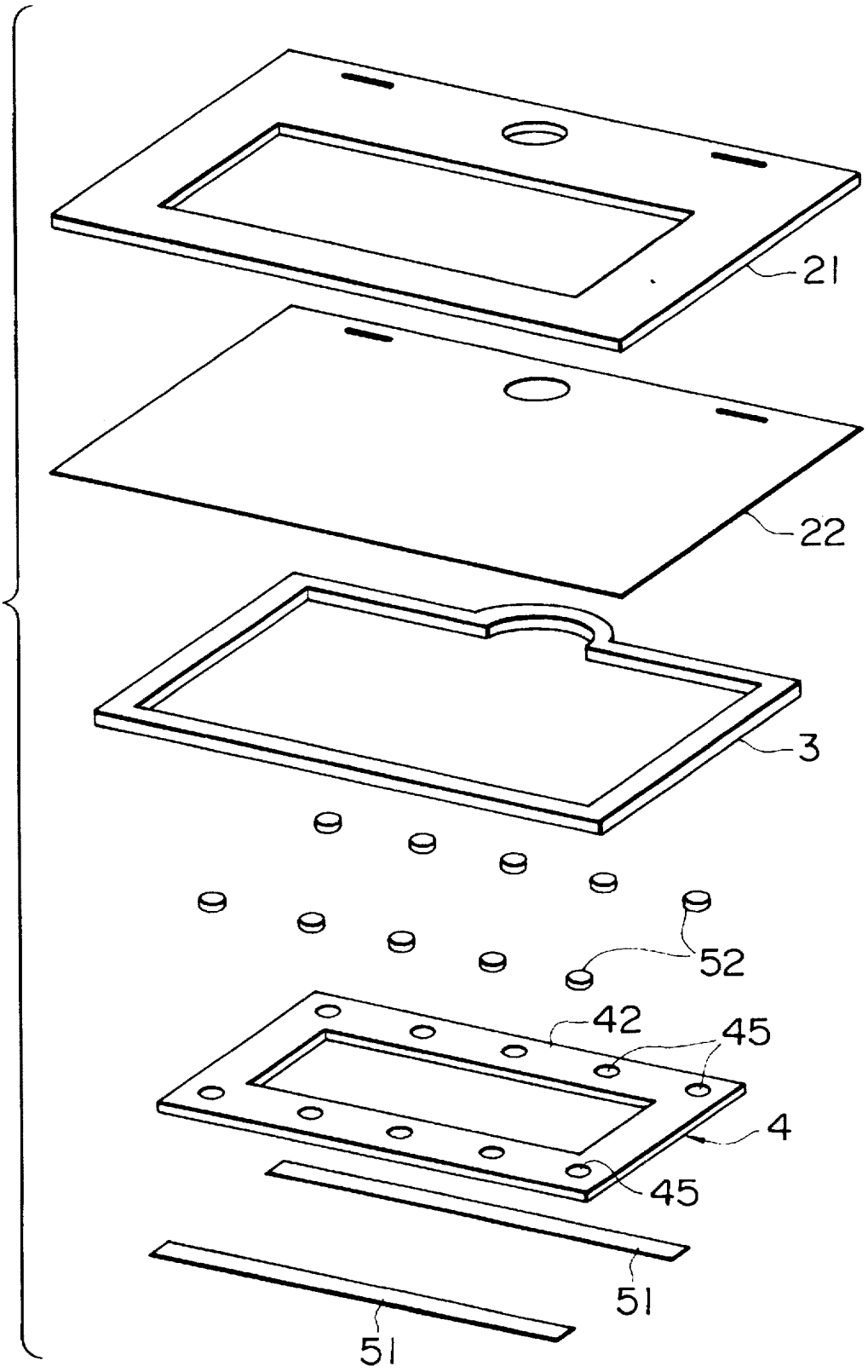
FIG. 8 is a perspective view showing the upper plate of FIGS. 7*a* and 7*b* in an exploded state.

In FIGS. 4 to 8, the same elements as in the embodiment of FIGS. 1 to 3 are denoted by the same numerical references. In this embodiment, the upper plate 2 is the same as that in FIGS. 1 to 3 in that it is constructed by sequentially laminating a diaphragm 22 and a frame-like packing 3 on a frame member 21, as shown in FIGS. 7 and 8. However, this embodiment is different from the embodiment of FIGS. 1 to 3 in that the packing 3 used in the former is a little more flexible than that of the latter, and the printing paper mount 13 used in the former is greater in air-permeability and elasticity than that of the latter. In this embodiment, it is preferable that the suction port 24 is disposed in the vicinity of the packing 3 and/or, the stencil supporting means 51, 52 or the frame 42 of the stencil unit 4 so that the lower plate 24 is prevented from coming into close contact with the suction port 24 to close it under reduced pressure. Further, this embodiment is greatly different from the embodiment of FIGS. 1–3 in that the frame 42 of the stencil unit 4 has each a row of five perforations 45 along each of the longitudinal sides thereof, and a pair of fabric fasteners 51 and 52 are used as means for supporting a stencil. One half 52 of the pair of fabric fasteners 51 and 52 is a series of protrusions which have the same configuration as perforations 45 and are disposed on the diaphragm 22 at the points corresponding to each perforations 45 of the stencil unit 4 so that the protrusions are received by the perforations 45 when the stencil unit 4 is installed on the upper plate 2. The other half 51 of the pair of fabric fastener 51 and 52 is a strip of the fabric fastener itself so that it can extend along and attached to the row of the five protrusions of the one half 52.

The term "pair of fabric fastener" herein means a pair of fabrics which can be repeatedly attached to or peeled from each other, and more specifically a pair of non-sticky fabrics one half of which has on a surface thereof a number of loops and the other half of which has on a surface thereof a number of hook-shaped fiber engageable with the loops, such as those commercially available under the tradename "Velcro" or "Magictape".

As shown in FIGS. 5 and 7, the stencil unit 4 can be fixed between the upper plate 2 and the strip of fabric fastener 51 by engaging each perforation 45 of the stencil unit 4 with each protrusion of fabric fastener 52 (see FIG. 5), and then attaching the strip of fabric fastener 51 to the row of the protrusions of fabric fastener 52 (see FIG. 7). In this case, the distance between the diaphragm 22 and the stencil unit 4 is shorter than that of the apparatus of FIGS. 1 to 3, and thus advantageously, thrust of the diaphragm 22 is applied to printing paper P effectively. Meanwhile, the upper plate 2 may be connected to the platform 1 to readily be opened and closed by use of a slit 27 shown in FIG. 7, a similar slit (not shown) of the lower plate 11 and a belt (not shown) or the like that connects the slits together.

In operation, printing paper P is placed on the mount 13 of the platform 1, and then the upper plate 2 on which the stencil unit 4 has been installed is built up on the lower plate 11 by way of the packing 3 to form a pressure chamber, as shown in FIG. 5. When pressure is reduced in the pressure chamber by use of pressure reducing means 6 connected to the suction port 24, the diaphragm 22 is brought into close contact with lumps 44 of ink placed on the stencil, and the stencil 41 is also brought into close contact with printing paper P. Further, since the diaphragm 22 exerts pressing force on the lumps 44 of ink, stencil printing is effected on printing paper P. In this instance, since the frame member 21 is made of a material flexible in all directions, the edges of the opening of the frame member is bent downwardly. Thus, the diaphragm 22 contacts the stencil unit well and applies thrust to the lumps of ink sufficiently. The diaphragm 22 is not forced to excessively be deformed, and thus is prevented from degrading. Since the stencil unit 4 is attached to the upper plate 2 by means of flexible fabric fasteners 51 and 52, inhibition of flexibility of the frame member 21, which would have been caused by conventional stencil supporting means such as rails, is eliminated. Besides, since the printing paper mount 13 and the packing 3 are shrunk under reduced pressure to narrow the distance between the upper plate 2 and the lower plate 11, the diaphragm 22 contacts the stencil unit and the lumps of ink more closely, and exerts pressing force thereon uniformly.

Figure 4:
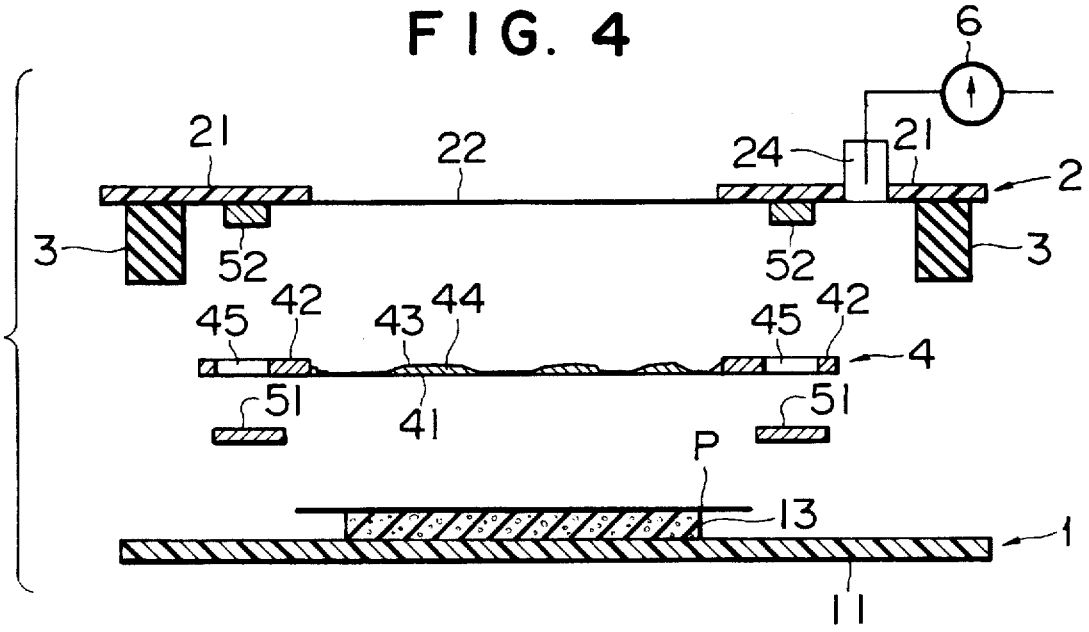
FIG. 4 is a sectional view showing another embodiment of the present stencil printing apparatus in an exploded state.
Figure 9:
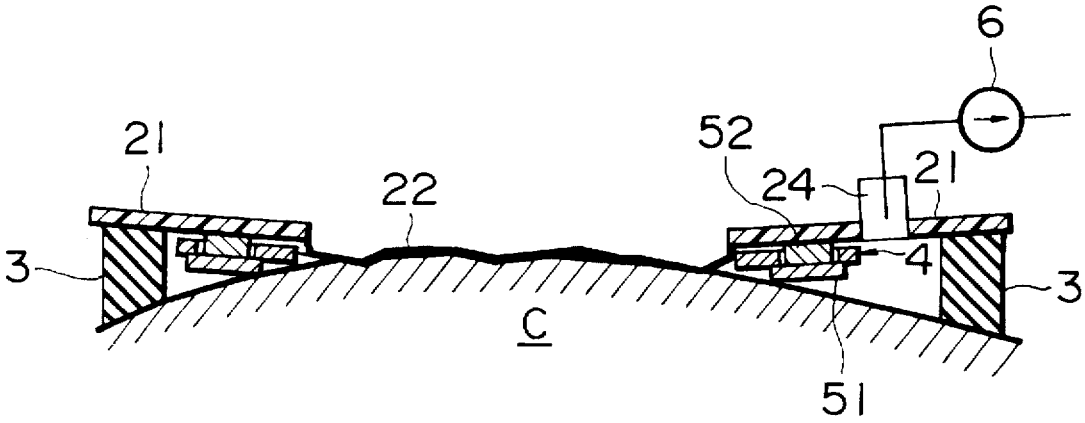
FIG. 9 is a sectional view showing the present stencil printing apparatus in use for printing directly on a curved surface.

FIG. 9 shows another embodiment of the present invention in which stencil printing is effected directly on a curved surface C by use of the upper plate 2 of FIGS. 4 to 6. In this embodiment, the upper plate 2 is placed directly on the curved surface C by way of the packing 3 after a stencil unit 4 on which lumps of ink are placed has been installed on the upper plate 2. In this state, a pressure chamber is formed by the upper plate 2, the packing 3 and the curved surface C. When pressure is reduced in the pressure chamber by use of a pressure reducing means 6 connected to the suction port 24 of the upper plate, the diaphragm 22 is brought in close contact with the lumps 44 of ink placed on the stencil and allows the stencil 41 to contact the curved surface C. Since the diaphragm 22 further exerts thrust on the lumps 44 of ink placed on the stencil, stencil printing is effected on the curved surface C. In this instance, since the frame member 21 is made of a material flexible in all directions, the edges of the opening of the frame member 21 is bent downwardly, and the diaphragm 21 can contact the curved surface C widely.

According to the present invention, the diaphragm is supported by a frame member, and the frame member is made flexible in all directions. Thus, the diaphragm readily comes in close contact with lumps of ink placed on a stencil, and uniformly exerts pressing force on the lumps of ink even if ink is placed unevenly. Also, printing can readily be effected even if a surface to be printed is curved. Further, since the diaphragm does not have to be bent much to exert thrust, it is prevented from degrading.

Particularly when the frame member is made of an elastic material, the frame member that has been bent under reduced pressure restores the flat shape after release of pressure reduction, so that the diaphragm is raised from its lateral portions. Also, the upper plate 2 can be flexed when it is opened. Thus, smooth operation of peeling the diaphragm from the stencil is possible. Also, opening and closing the upper plate 2 is facilitated thanks to the flexibility of the upper plate 2.

According to the present invention, a pressure chamber can be formed by layering a first wall over a second wall via a packing, and the first wall may be a frame on which the diaphragm is extended and the first and the second wall may be planar. Thus, the structure of the stencil printing apparatus is simplified as a whole.

According to the present invention, the printing apparatus may be a frame on which is laminated a diaphragm on which a packing and means for supporting a stencil are disposed. Only if it is placed via the packing on a platform on which a printing paper mount is placed or a glass or wall surface of buildings, a pressure chamber is formed to effect printing. Also, it is possible to consolidate expendable supplies such as the diaphragm, the packing and the means for supporting a stencil into one unit or module so that the packing and the stencil supporting means are replaced with new ones at a time when the diaphragm is replaced. Thus, the structure and the assembly of the printing apparatus are simplified.

We claim:

1. A stencil printing method which comprises the combination of steps of:

placing a lump of printing ink on a side of a stencil, said lump having a sufficient consistency to hold its shape, providing a pressure chamber which has a first wall constituted by a frame member, and a diaphragm having flexibility extended on said frame member, said frame member having a flexibility sufficient to bend in all directions when pressure is reduced in said pressure chamber, disposing said stencil in said pressure chamber so that the side of the stencil on which the printing ink has been placed, faces said diaphragm, and reducing pressure in the pressure chamber to bend the frame to a surface to be printed whereby stencil printing is effected on the surface by virtue of pressing force exerted by the diaphragm.

2. A stencil printing method according to claim 1, in which said pressure chamber is formed by building up said first wall via a frame-like packing on a second wall placed opposite to said first wall.

3. A stencil printing method according to claim 2, in which said packing is impermeable to air and elastic.

4. A stencil printing apparatus which comprises a pressure chamber having a first wall and a second wall both of which face each other and are built up together via a frame-like packing, said first wall comprising a frame member which has sufficient flexibility to bend in all directions in response to a reduction in pressure in said pressure chamber and on which a flexible diaphragm is extended, means for supporting a stencil so as to have the stencil disposed opposite to said diaphragm in the pressure chamber, means for supporting printing paper so as to have the printing paper disposed between the stencil and the second wall in the pressure chamber, and means for reducing pressure in the pressure chamber.

5. A stencil printing apparatus defined claim 4, in which said diaphragm is extended by laminating it onto the frame member.

6. A stencil printing apparatus defined in claim 5, in which said packing and said means for supporting a stencil are installed on part of said diaphragm overlapping with the frame member.

7. A stencil printing apparatus defined in claim 4, in which said packing is impermeable to air and elastic.

8. A stencil printing apparatus defined in claim 7, in which said packing is flexible, and said means for supporting printing paper is an air-permeable and elastic mount on which printing paper is placed.

9. A stencil printing apparatus defined in claim 8, in which the frame member has a suction port connected to said means for reducing pressure, said suction port being positioned in the vicinity of at least one of said packing, said means for supporting a stencil and an edge of the stencil so as to prevent the second wall from coming into contact with said suction port to close it under reduced pressure.

10. A stencil printing apparatus defined in claim 4, in which said frame member is elastic.

11. A stencil printing apparatus defined in claim 4, in which said means for supporting a stencil is a pair of fabric fastener, one half of the pair being fixed to the frame member.

12. A stencil printing apparatus defined in claim 11, in which the one half of said pair is segments of fabric fastener, said stencil having perforations which receive the segments of fabric fastener so that the one half can be attached through the perforation to the other half to fix the stencil on the frame member.

13. A stencil printing apparatus which comprises a wall comprising a frame member on which a diaphragm having flexibility is extended, a frame-like packing disposed on said frame member to define a sealed chamber between said wall and a surface on which said wall is placed via said packing, means for supporting a stencil so as to have the stencil disposed opposite to said diaphragm, and means for reducing pressure in said chamber space, said frame member being sufficiently flexible to be capable of bending in all directions in response to a reduction in pressure in said chamber.

* * * * *